US009359860B2

(12) United States Patent
Hallundbæk et al.

(10) Patent No.: US 9,359,860 B2
(45) Date of Patent: Jun. 7, 2016

(54) ANNULAR BARRIER

(75) Inventors: Jorgen Hallundbæk, Græsted (DK); Paul Hazel, Aberdeen (GB); Tomas Sune Andersen, Helsingør (DK)

(73) Assignee: WELLTEC A/S, Allerød (DK)

( * ) Notice: Subject to any disclaimer, the term of this patent is extended or adjusted under 35 U.S.C. 154(b) by 357 days.

(21) Appl. No.: 13/877,753

(22) PCT Filed: Oct. 6, 2011

(86) PCT No.: PCT/EP2011/067463

§ 371 (c)(1),
(2), (4) Date: Apr. 4, 2013

(87) PCT Pub. No.: WO2012/045813

PCT Pub. Date: Apr. 12, 2012

(65) Prior Publication Data

US 2013/0186615 A1 Jul. 25, 2013

(30) Foreign Application Priority Data

Oct. 7, 2010 (WO) ..... PCT/EP2010/064985

(51) Int. Cl.
*E21B 23/06* (2006.01)
*E21B 33/127* (2006.01)

(52) U.S. Cl.
CPC ..... *E21B 33/1277* (2013.01); *E21B 23/06* (2013.01); *E21B 33/127* (2013.01)

(58) Field of Classification Search
CPC ..... E21B 23/04; E21B 23/06; E21B 23/065; E21B 33/1212; E21B 33/1216; E21B 33/127; E21B 33/1277
See application file for complete search history.

(56) References Cited

U.S. PATENT DOCUMENTS

| | | | | |
|---|---|---|---|---|
| 3,581,816 | A | 6/1971 | Malone | |
| 4,349,204 | A | 9/1982 | Malone | |
| 4,403,660 | A | 9/1983 | Coone | |
| 4,614,346 | A * | 9/1986 | Ito | 277/334 |
| 4,768,590 | A * | 9/1988 | Sanford et al. | 277/334 |

(Continued)

FOREIGN PATENT DOCUMENTS

| | | |
|---|---|---|
| EP | 2 206 879 | 7/2010 |
| RU | 2 265 118 C2 | 11/2005 |

(Continued)

OTHER PUBLICATIONS

International Search Report for PCT/EP2011/067463, mailed Nov. 4, 2011.

(Continued)

*Primary Examiner* — Cathleen Hutchins
(74) *Attorney, Agent, or Firm* — Nixon & Vanderhye P.C.

(57) ABSTRACT

The present invention relates to an annular barrier for being expanded in an annulus between a well tubular structure and an inside wall of a borehole downhole. The annular barrier comprises a tubular part for mounting as part of the well tubular structure; an expandable sleeve made of a first metal, surrounding the tubular part and defining a space being in fluid communication with an inside of the tubular part, the expandable sleeve having a longitudinal extension, an inner face facing the tubular part and two ends; a connection part made of a second metal, connecting the expandable sleeve with the tubular part; an opening for letting fluid into the space to expand the sleeve, and a transition area comprising a connection of the sleeve with the connection part.

24 Claims, 7 Drawing Sheets

(56) References Cited

U.S. PATENT DOCUMENTS

| | | | | |
|---|---|---|---|---|
| 4,892,144 | A * | 1/1990 | Coone | 277/334 |
| 5,027,894 | A * | 7/1991 | Coone et al. | 166/122 |
| 2007/0114016 | A1 | 5/2007 | Brezinski et al. | |

FOREIGN PATENT DOCUMENTS

| | | |
|---|---|---|
| RU | 2265118 | 11/2005 |
| SU | 759703 | 8/1980 |
| SU | 926238 | 5/1982 |

OTHER PUBLICATIONS

Written Opinion of the International Searching Authority for PCT/EP2011/067463, mailed Nov. 4, 2011.

International Preliminary Report on Patentability for International Application No. PCT/EP2011/067463 dated Apr. 18, 2013.

Office Action issued Oct. 14, 2015, in a corresponding Russian Patent Application No. RU 2013 120 131 (5 pages).

A.A. Gaivoronsky et al., "Wall Packer of PPM Type for Wells Testing and Workover", 1977, published in NTS *Machines and Petroleum Equipment*, vol. 11 (not publicly available) (3 pages) and English translation thereof (3 pages).

A.A. Appen, "Khimiya", Leningrad 1976, published in *Thermostable Inorganic Coatings*, 2nd Edition, Revised and Enlarged (1 page). and English translation of relevant portion (p. 255, lines 7-9) (1 page).

* cited by examiner

ANNULAR BARRIER

This application is the U.S. national phase of International Application No. PCT/EP2011/067463, filed 6 Oct. 2011, which designated the U.S. and claims priority to EP Application No. PCT/EP2010/064985, filed 7 Oct. 2010, the entire contents of each of which are hereby incorporated by reference.

FIELD OF THE INVENTION

The present invention relates to an annular barrier for being expanded in an annulus between a well tubular structure and an inside wall of a borehole downhole. The annular barrier comprises a tubular part for mounting as part of the well tubular structure; an expandable sleeve made of a first metal, surrounding the tubular part and defining a space being in fluid communication with an inside of the tubular part, the expandable sleeve having a longitudinal extension, an inner face facing the tubular part and two ends.

BACKGROUND ART

In wellbores, annular barriers are used for different purposes, such as for providing a barrier for flow between an inner and an outer tubular structure or between an inner tubular structure and the inner wall of a borehole. The annular barriers are mounted as part of the well tubular structure. An annular barrier has an inner wall surrounded by an annular expandable sleeve. The expandable sleeve is typically made of an elastomeric material, but may also be made of metal. The sleeve is fastened at its ends to the inner wall of the annular barrier.

In order to seal off a zone between an inner and an outer tubular structure or a well tubular structure and the borehole, a second annular barrier is used. The first annular barrier is expanded on one side of the zone to be sealed off, and the second annular barrier is expanded on the other side of that zone, and in this way, the entire zone is sealed off.

The pressure envelope of a well is governed by the burst rating of the tubular and the well hardware etc. used within the well construction. In some circumstances, the expandable sleeve of an annular barrier may be expanded by increasing the pressure in the well, which is the most cost efficient way of expanding the sleeve. The burst rating of a well defines the maximum pressure that can be applied to the well for expansion of the sleeve, and it is desirable to minimise the expansion pressure required for expanding the sleeve to minimise the exposure of the well to the expansion pressure.

When expanded, annular barriers may be subjected to a continuous pressure or a periodic high pressure from the outside, either in the form of hydraulic pressure within the well environment or in the form of formation pressure. In some circumstances, such pressure may cause the annular barrier to collapse, which may have severe consequences for the area which the barrier is to seal off, as the sealing properties are lost due to the collapse.

The ability of the expanded sleeve of an annular barrier to withstand the collapse pressure is thus affected by many variables, such as strength of material, wall thickness, profile of the expanded sleeve, surface area exposed to the collapse pressure, temperature, well fluids, etc.

A collapse rating currently achievable of the expanded sleeve within certain well environments is insufficient for all well applications. Thus, it is desirable to increase the collapse rating to enable annular barriers to be used in all wells, specifically in wells that experience a high drawdown pressure during production and depletion. The collapse rating may be increased by increasing the wall thickness or the strength of the material; however, this would increase the expansion pressure, which, as mentioned, is not desirable.

It is thus desirable to provide a solution wherein the collapse rating of expanded sleeves is increased.

SUMMARY OF THE INVENTION

It is an object of the present invention to wholly or partly overcome the above disadvantages and drawbacks of the prior art. More specifically, it is an object to provide an improved annular barrier with an increased collapse rating of the expandable sleeve.

A further object of the present invention is to provide an annular barrier having an increased collapse rating without increasing the strength of the material and/or wall thickness of the sleeve.

The above objects, together with numerous other objects, advantages, and features, which will become evident from the below description, are accomplished by a solution in accordance with the present invention by an annular barrier for being expanded in an annulus between a well tubular structure and an inside wall of a borehole downhole, comprising

- a tubular part for mounting as part of the well tubular structure,
- an expandable sleeve made of a first metal, surrounding the tubular part and defining a space being in fluid communication with an inside of the tubular part, the expandable sleeve having a longitudinal extension, an inner face facing the tubular part and two ends,
- a connection part made of a second metal, connecting the expandable sleeve with the tubular part,
- an opening for letting fluid into the space to expand the sleeve, and
- a transition area comprising a connection of the sleeve with the connection part, wherein the first metal is more flexible than the second metal.

The tubular part may have an inner unexpanded diameter being the same as an inner diameter of the well tubular structure.

Hereby, the annular barrier does not hinder the passage of tools submerged into the well tubular part for other operations further down the well. Annular barriers may be activated several years after insertion to provide an isolation of a first zone from a second zone, e.g. in order to optimise the production. In this time span from insertion to activation, the annular barriers merely function as part of the well tubular structure and cannot diminish the inner diameter of the well tubular structure as this is unacceptable with regard to later operations.

Said tubular part may have an inner diameter being substantially the same before and after expansion of the expandable sleeve.

By the first metal being more flexible than the second metal is meant that the metal of the expandable sleeve has an elongation higher than the elongation of the metal of the connection part.

By having a connection part and a sleeve of two different metals, it is possible to machine the connection part so as to fit the tubular part perfectly without changing the material of the sleeve and the expansion ability of the sleeve.

In an embodiment, the annular barrier may comprise a restriction element in the transition area, restricting a free expansion of the sleeve in the area.

By having a connection part and a sleeve made of two different metals as well as a restriction element, the collapse rating of the expandable sleeve is increased without increasing the wall thickness of the expandable sleeve or the overall diameter of the annular barrier. Furthermore, by the present invention, the expansion pressure necessary to expand the expandable sleeve will not be increased, or may even be lowered.

In an embodiment, the connection part and the sleeve may be welded together.

Furthermore, the transition area may extend along the longitudinal extension of the expandable sleeve from a first point at the connection to a predetermined second point on the expandable sleeve.

In addition, the second point may be arranged on an unrestricted part of the expandable sleeve.

The expandable sleeve may be more restricted in expanding at the first point than at the second point.

Also, the restriction element may be a projecting part of the connection part.

Moreover, the expandable sleeve may be restricted in expanding in the transition area by the projecting part of the connection part.

Additionally, the projecting part may taper towards the expandable sleeve.

Furthermore, each end of the expandable sleeve may have a tapering shape corresponding to the shape of the projecting part.

Moreover, the restriction element may be an additional ring surrounding the expandable sleeve, the additional ring being connected with the connection part and tapering from the connection part towards the expandable sleeve.

Also, the expandable sleeve may be restricted in expanding in the transition area by an additional ring surrounding the expandable sleeve, the additional ring being connected with the connection part and tapering from the connection part towards the expandable sleeve.

Furthermore, the restriction element may be an increased thickness of the expandable sleeve, provided by adding an additional material at least on its outside, which material tapers from the connection part towards the sleeve.

In addition, the expandable sleeve may be restricted in expanding in the transition area by an increased thickness of the expandable sleeve provided by adding an additional material at least on its outside, which material tapers from the connection part towards the sleeve.

Moreover, the additional material may be added by means of welding.

In an embodiment, the thickness of the expandable sleeve may decrease from a thickness of the connection part to a thickness less than 95% of the thickness of the connection part, preferably a thickness less than 90% of the thickness of the connection part, and more preferably a thickness less than 80% of the thickness of the connection part.

Furthermore, the first metal may have an elongation of 35-70%, at least 40%, preferably 40-50%. The first metal may have a yield strength (soft annealed) of 200-400 MPa, preferably 200-300 MPa.

Also, the second metal may have an elongation of 10-35%, preferably 25-35%. The second metal may have a yield strength (cold worked) of 500-1000 MPa, preferably 500-700 MPa.

Furthermore, the metal of the expandable sleeve may have an elongation of at least 5 percentage points, preferably at least 10 percentage points higher than the elongation of the metal of the connection part.

In addition, sections of the expanded sleeve may have an increased wall thickness, resulting in a corrugated expanded sleeve. The corrugations will be annular and strengthen the expanded sleeve even further.

As a consequence, the annular barrier according to invention is capable of withstanding a higher collapse pressure than prior art annular barriers and will thus also have enhanced sealing capabilities.

Furthermore, the sleeve may be provided with sealing elements on its outside.

The sealing elements may have a tapering or triangular cross-sectional shape.

The expandable sleeve may be capable of expanding to an at least 10% larger diameter, preferably an at least 15% larger diameter, more preferably an at least 30% larger diameter than that of an unexpanded sleeve and it may have a wall thickness which is thinner than a length of the expandable sleeve, the thickness preferably being less than 25% of its length, more preferably less than 15% of its length, and even more preferably less than 10% of its length.

In one embodiment, the expandable sleeve may have a varying thickness along the periphery and/or length.

In addition, at least one of the connection parts may be slidable in relation to the tubular part of the annular barrier, and at least one sealing element, such as an O-ring, may be arranged between the slidable connection part and the tubular part. In one embodiment, more than one sealing element may be arranged between the slidable fastening means and the tubular part.

At least one of the connection parts may be fixedly fastened to the tubular part or be part of the tubular part.

The connection part may have a projecting edge part which projects outwards from the tubular part.

Also, the tubular part may have two sections at opposing sides of an intermediate part and at a distance from the opening in the tubular structure, the tubular part having, in the sections, an increased outer diameter and an increased wall thickness in relation to an outer diameter and a wall thickness of the intermediate part of the tubular part.

Moreover, the connection parts may be arranged opposite the two sections.

Further, one of the connection parts may be arranged in a sliding manner in relation to the section of the tubular part and the other connection part may be fastened to the tubular part in a sealing connection.

Additionally, the sealing connection may seal the space together with sealing means arranged in the slidable connection part.

Each connection part may have a projecting part overlapping the expandable sleeve.

Said projecting part of the connection part may be welded together with the expandable sleeve.

The invention further relates to an annular barrier system comprising an expansion tool and an annular barrier as described above. The expansion tool may comprise explosives, pressurised fluid, cement, or a combination thereof.

In one embodiment, the annular barrier system may comprise at least two annular barriers positioned at a distance from each other along the well tubular structure.

Moreover, the invention finally relates to a downhole system comprising a well tubular structure and at least one annular barrier as described above.

In one embodiment of the downhole system, a plurality of annular barriers may be positioned at a distance from each other along the well tubular structure.

BRIEF DESCRIPTION OF THE DRAWINGS

The invention and its many advantages will be described in more detail below with reference to the accompanying schematic drawings, which for the purpose of illustration show some non-limiting embodiments and in which.

Figure 1:
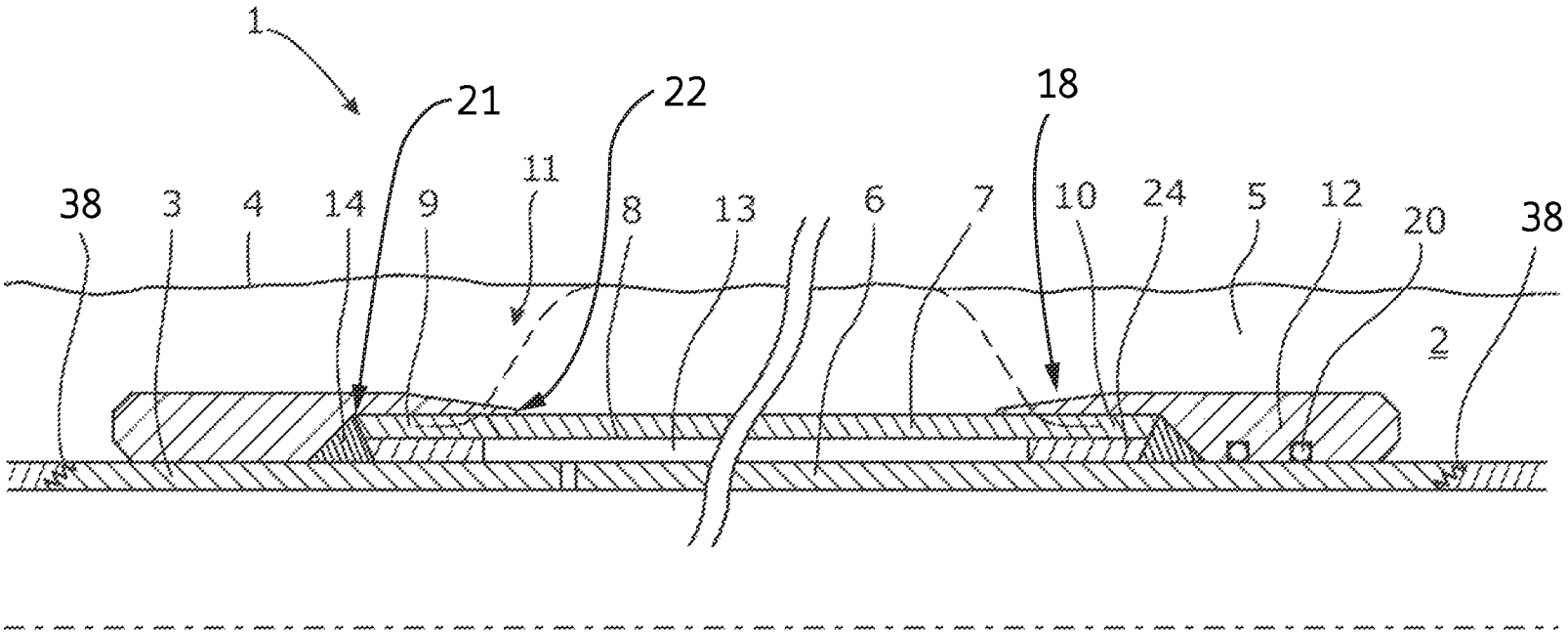
FIG. 1 shows an annular barrier according to the invention.

All the figures are highly schematic and not necessarily to scale, and they show only those parts which are necessary in order to elucidate the invention, other parts being omitted or merely suggested.

DETAILED DESCRIPTION OF THE INVENTION

Annular barriers 1 according to the present invention are typically mounted as part of the well tubular structure string before the well tubular structure 3 is lowered into the borehole 5 downhole. The well tubular structure 3 is constructed by well tubular structure parts put together as a long well tubular structure string. Often, the annular barriers 1 are mounted in between the well tubular structure parts when the well tubular structure string is mounted.

The annular barrier 1 is used for a variety of purposes, all of which require that an expandable sleeve 7 of the annular barrier 1 is expanded so that the sleeve abuts the inside wall 4 of the borehole 5. The annular barrier 1 comprises a tubular part 6 which is connected to the well tubular structure 3, as shown in FIG. 1, e.g. by means of a thread connection 38.

In FIG. 1, the annular barrier 1 is shown in a cross-section along the longitudinal extension of the annular barrier. The annular barrier 1 is shown in its unexpanded state, i.e. in a relaxed position, from which it is to be expanded in an annulus 2 between a well tubular structure 3 and an inside wall 4 of a borehole 5 downhole. The annular barrier 1 comprises a tubular part 6 for mounting as part of the well tubular structure 3 and an expandable sleeve 7. The expandable sleeve 7 surrounds the tubular part 6 and has an inner face 8 facing the tubular part 6. Each end 9, 10 of the expandable sleeve 7 is connected with a connection part 12 which again is connected with the tubular part 6. The expandable sleeve 7 is made of a first metal alloy and the connection part 12 is made of a second metal alloy which is less flexible than the first metal alloy. The connection part 12 has a projecting part 18 overlapping the expandable sleeve 7. The connection part 12 is welded together with the expandable sleeve 7 in a connection 14. An inner ring 24 is arranged between the expandable sleeve 7 and the tubular part 6 and is welded in the same connection 14. The projecting part 18 of the connection part 12 increasingly tapers towards the expandable sleeve 7 until the projecting part 18 does not overlap the expandable sleeve 7 anymore and the expandable sleeve 7 is free to expand.

The projecting part 18 and the connection 14 form part of a transition area 11 extending along the longitudinal extension of the expandable sleeve 7 from a first point 21 at the connection to a predetermined second point 22 on an unrestricted part of the expandable sleeve 7. The projecting part 18 has the purpose of restricting the expansion of the expandable sleeve 7 so that the curvature (shown by a dotted line in FIG. 1) of the expandable sleeve 7 is more S-shaped. It is hereby obtained that the expandable sleeve 7 does not fracture during expansion and that the cross-sectional profile of the expandable sleeve 7 is capable of withstanding a higher collapse pressure than a known annular barrier. Thus, the expandable sleeve 7 is more restricted in expanding at the first point than at the second point. Furthermore, due to the fact that the projecting part 18 is made of a less flexible metal alloy and tapers from the connection towards the second point, the expandable sleeve 7 is less restricted in expanding along with the decreasing thickness of the projecting part.

Figure 2:
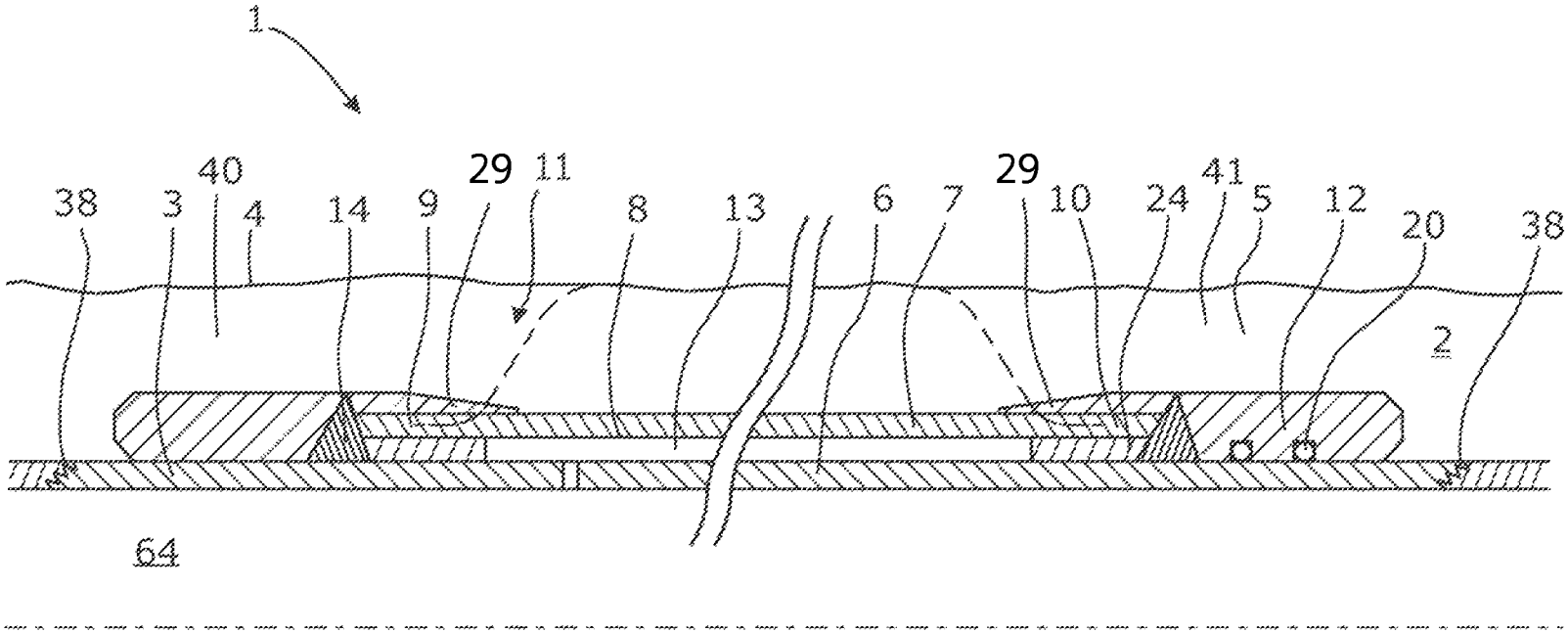
FIG. 2 shows another embodiment of the annular barrier.

FIG. 2 shows a cross-sectional view of the annular barrier 1 in which the connection part 12 is connected with an outer ring 29, the expandable sleeve 7 and the inner ring 24. The expandable sleeve 7 is made of a first metal alloy and the connection part is made of a second metal alloy which is less flexible than the first metal alloy. The connection 14 is a welded connection. The outer ring 29 forms part of the transition area 11 in which the expandable sleeve 7 is restricted in expanding freely. The outer ring 29 has a decreasing thickness tapering from the connection 14 towards the unrestricted part of the expandable sleeve 7. The outer ring 29 is made of the second metal alloy which is less flexible than the metal alloy of the sleeve, and the outer ring 29 has the purpose of restricting the expansion of the expandable sleeve 7 so that the curvature (shown by a dotted line in FIG. 1) of the expandable sleeve 7 is more S-shaped. It is hereby obtained that the expandable sleeve 7 does not fracture during expansion, and the cross-sectional profile of the expandable sleeve 7 is capable of withstanding a higher collapse pressure than a known annular barrier.

Figure 3:
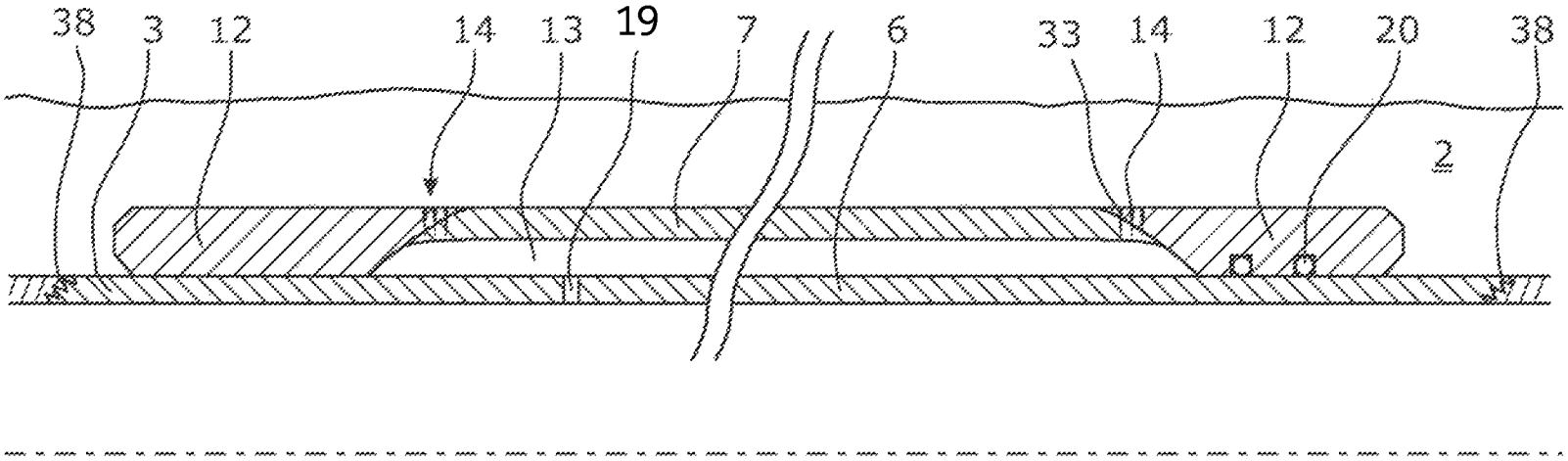
FIG. 3 shows yet another embodiment of the annular barrier.

FIG. 3 shows a cross-sectional view of the annular barrier 1 in which the expandable sleeve 7 tapers towards the connection part 12, and the connection part has a corresponding shape. The tapering part 33 of the expandable sleeve 7 and the tapering part of the connection part 12 overlap and are welded together. The welded connection 14 and the tapering part of the connection part 12 extending from the connection 12 in an overlapping relationship with the expandable sleeve 7 form part of the transition area 11. The expandable sleeve 7 is made of a first metal alloy and the connection part is made of a second metal alloy which is less flexible than the first metal alloy. The tapering part of the connection part 12 overlapping the sleeve restricts the expandable sleeve 7 in expanding freely so that the curvature (shown by a dotted line in FIG. 1) of the expandable sleeve 7 is more S-shaped. It is hereby obtained that the expandable sleeve 7 does not fracture during expansion, and the cross-sectional profile of the expandable sleeve 7 is capable of withstanding a higher collapse pressure than a known annular barrier.

Figure 4:
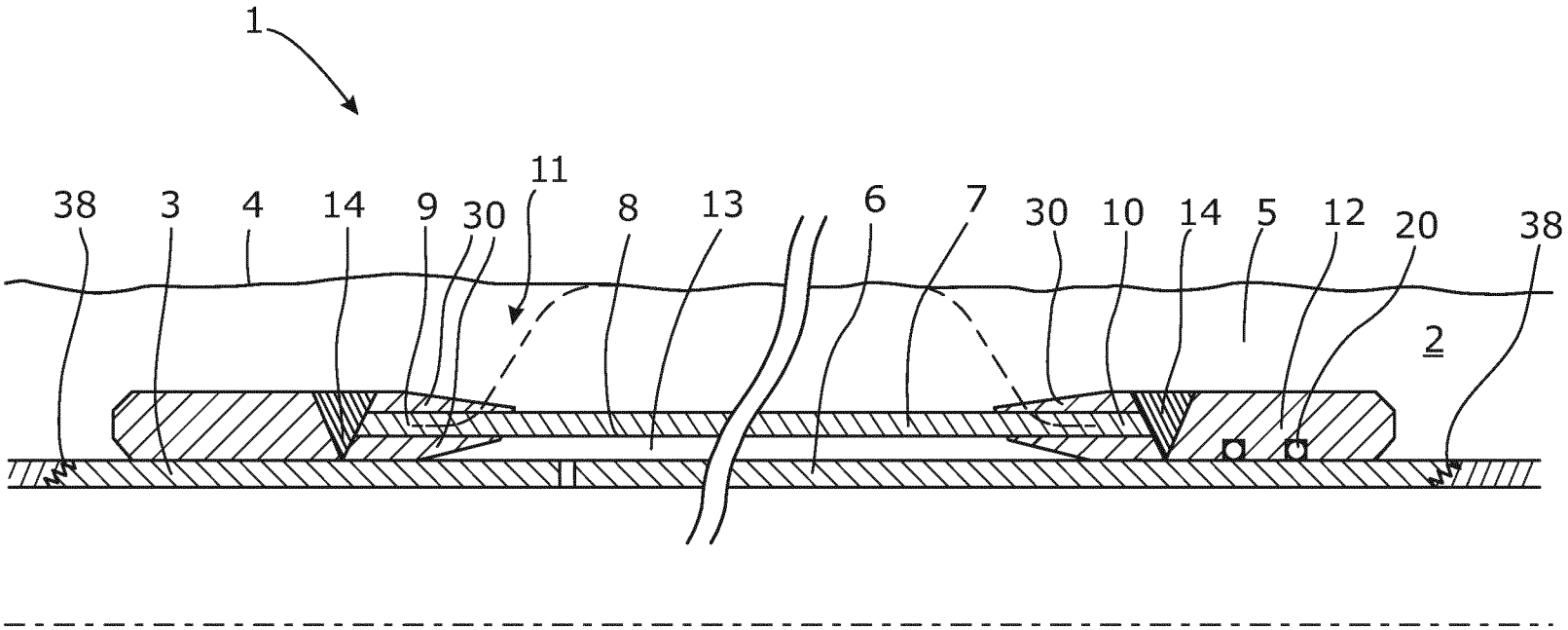
FIG. 4 shows yet another embodiment of the annular barrier.

FIG. 4 is a cross-sectional view of the annular barrier 1 in which the expandable sleeve 7 is welded together with the connection part 12, forming the connection 14 there between. The expandable sleeve 7 is made of a first metal alloy and the connection part 12 is made of a second metal alloy which is less flexible than the first metal alloy. In addition, an additional material 30 is added in the transition area 11 from the connection 14 along a first part of the expandable sleeve 7. The additional material 30 decreases in thickness from the connection 14 along the expandable sleeve 7. The additional material 30 is made of the same material as the connection part 12 or of metal alloy which is even less flexible than the metal alloy of the connection part 12. The connection 14 and the additional material 30 form part of the transition area 11, and the additional material 30 hinders the expandable sleeve 7 in expanding too much in the transition area, and the sleeve thus forms a more S-shaped cross-sectional profile after expansion. Hereby, the collapse pressure is increased compared to known annular barriers.

When the expandable sleeve 7 is made of a first metal alloy and the connection part is made of a second metal alloy which is less flexible than the first metal alloy, the metal alloy of the connection part 12 can be a metal alloy which is more machinable than the metal alloy of the sleeve 7. When making the connection part 12, it is important that it can be machined so as to fit the tubular part more perfectly, thus forming a tighter seal, and even a metal-to-metal seal. As can be seen, a space or cavity 13 is formed between the inner face 8 of the sleeve 7 and the tubular part 6. In order to expand the expandable sleeve 7, pressurised fluid is injected into the cavity 13 through an expansion tool 15, such as a hole 19 or a valve 19, until the expandable sleeve 7 abuts the inside wall 4 of the borehole 5. The cavity 13 may also be filled with cement or the like in order to expand the sleeve 7. The expansion tool 15 may also be an explosive.

When annular barriers 1 are expanded, they are exposed to a certain pressure. However, the pressure may vary during production. As the pressure may thus increase, the annular barrier 1 must be capable of withstanding an increased pressure, also called "the collapse pressure", also in its expanded state, when the outer diameter of the annular barrier 1 is at its maximum and its wall thickness thus at its minimum. In order to withstand such an increased pressure, the expandable sleeve 7 may be provided with at least one element 14.

When the expandable sleeve 7 of the annular barrier 1 is expanded, the diameter of the sleeve is expanded from its initial unexpanded diameter to a larger diameter. The expandable sleeve 7 has an outside diameter D and is capable of expanding to an at least 10% larger diameter, preferably an at least 15% larger diameter, more preferably an at least 30% larger diameter than that of an unexpanded sleeve 7.

Furthermore, the expandable sleeve 7 has a wall thickness t which is thinner than a length L of the expandable sleeve, the thickness preferably being less than 25% of the length, more preferably less than 15% of the length, and even more preferably less than 10% of the length.

The expandable sleeve 7 of the annular barrier 1 is made of a first metal having an elongation of 35-70%, at least 40%, preferably 40-50%, and the connection part is made of a second metal having an elongation of 10-35%, preferably 25-35%. The metal of the connection part has an elongation of at least 5 percentage points, preferably at least 10 percentage points higher than the elongation of the metal of the expandable sleeve. The yield strength (soft annealed) of the metal of the expandable sleeve is 200-400 MPa, preferably 200-300 MPa. The yield strength (cold worked) of the metal of the connection part is 500-1000 MPa, preferably 500-700 MPa. Thus, the first metal is more flexible than the second metal.

Providing the annular barrier 1 with a valve 19 makes it possible to use other fluids than cement, such as the fluid present in the well or sea water, for expanding the expandable sleeve 7 of the annular barrier.

As can be seen, the expandable sleeve 7 is a thin-walled tubular structure, the ends 9, 10 of which have been inserted into the connection part 12. Subsequently, the connection part 12 has been embossed, changing the design of the fastening means and the ends 9, 10 of the expandable sleeve and thereby mechanically fastening them in relation to one another. In order to seal the connection between the expandable sleeve 7 and the connection part 12, a sealing element may be arranged between them.

Figure 6:
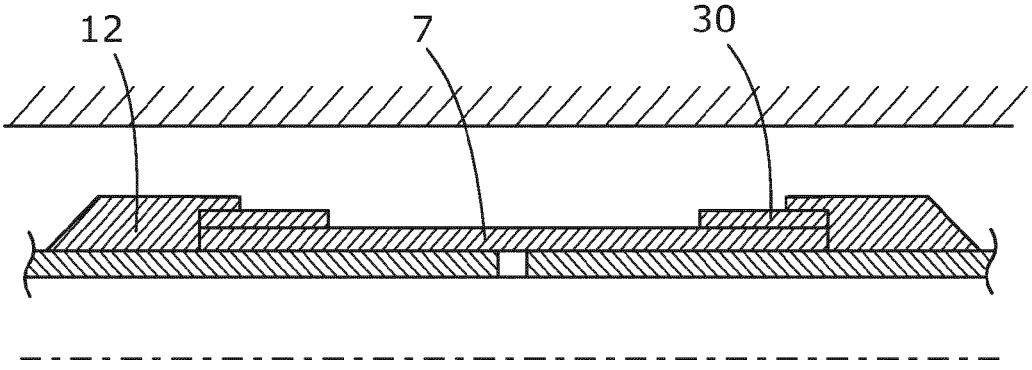
FIG. 6 shows yet another embodiment of the annular barrier.

In FIG. 6, another annular barrier 1 is shown, wherein the expandable sleeve 7 of the annular barrier 1 has been laminated with an additional material 30 in predetermined areas, i.e. in those areas where the expanded sleeve 7 is exposed to maximum hydraulic pressure. Advantageously, this additional material 30 may be stronger than the material of which the rest of the expandable sleeve is made.

Normally, a stronger material will be less ductile. When only laminating the expandable sleeve 7 with the additional stronger material 30 in certain areas, an increased collapse rating of the expandable sleeve may, however, be achieved without affecting the expansion properties of sleeve.

Lamination of the expandable sleeve 7 may be performed in many different ways, e.g. by laser welding of dissimilar metals, cladding, etc.

When a stronger but less ductile material 30 is laminated onto the expandable sleeve 7, the material of which is not quite as strong but more ductile, the result is an expandable sleeve which is still sufficiently ductile, but the collapse rating of which is increased. In its expanded state, the sleeve 7 will thus be capable of withstanding a higher pressure close to or at the point of lamination.

Figure 8:
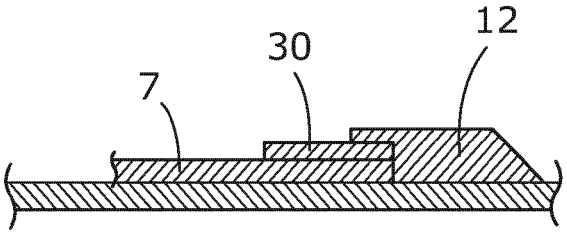
FIG. 8 shows an enlarged partial view of FIG. 6.

When the expandable sleeve 7 is laminated with an additional material 30 in certain areas, the wall thickness of the sleeve is increased in these areas. This increase in the wall thickness is more easily deduced from FIG. 8.

Figure 7:
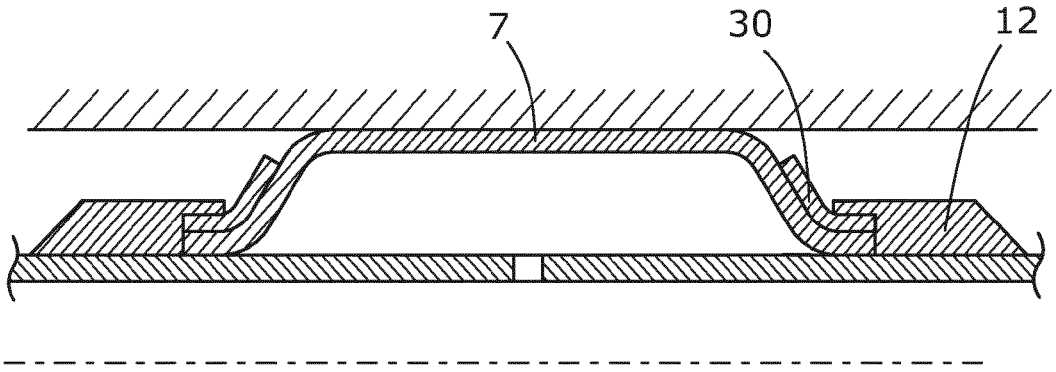
FIG. 7 shows the annular barrier of FIG. 6 in its expanded state.

FIG. 7 shows a cross-sectional view of the annular barrier 1 of FIG. 6 in its expanded state. In this embodiment, the additional material 30 with which the sleeve 7 has been laminated provides an increased collapse rating of the expandable sleeve and thus of the annular barrier 1.

Figure 9:
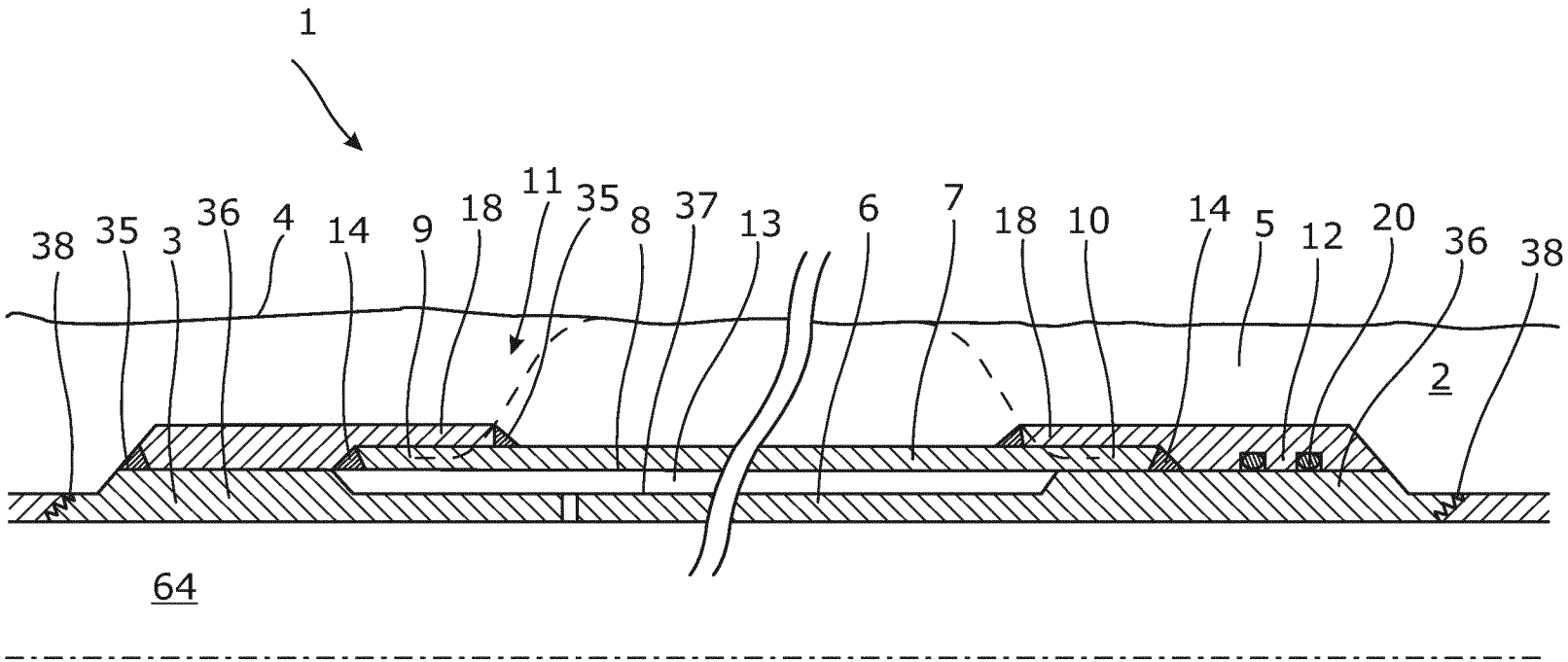
FIG. 9 shows yet another embodiment of the annular barrier in its expanded state.

In FIG. 9, the tubular part 6 has two sections 36 having an increased outer diameter and thus the tubular part has an increased thickness at two sections 36 at opposing sides and at a distance from the opening in the tubular structure. Between the sections, the tubular part has an intermediate section 37. The connection parts 12 are arranged opposite the two sections 36 and one of the connection parts 12 is arranged in a sliding manner in relation to the section 36 of the tubular part. The other connection part 12 is welded to the tubular part in a connection 35 and is, in this way, fixedly arranged in relation to the tubular part, and the welded connection 35 provides a sealing connection sealing the space 13 together with sealing means 20 arranged in the slidable connection part 12.

The expandable sleeve 7 of FIG. 9 is made of a first metal alloy and the connection part 12 is made of a second metal alloy which is less flexible than the first metal alloy. The two sections may be material welded on the outside of the tubular part 6 and then the sections are machined and polished to have a precise outer diameter at the sections before mounting the connection parts 12. Hereby, a very smooth surface is provided so that a very tight seal between the sealing means 20 and the tubular part can be accomplished.

The connection part 12 has a projecting part 18 overlapping the expandable sleeve 7. The connection part 12 is welded together with the expandable sleeve 7 in a connection 14. The projecting part 18 of the connection part 12 projects overlapping part of the expandable sleeve 7. At the end of the projecting part 18, it may be fastened to the expandable sleeve, e.g. by means of welding in a welded connection 34. In another aspect, the projecting part is not fastened to the expandable sleeve 7. However, as the projecting part overlaps the expandable sleeve 7, the sleeve 7 is not totally free to expand.

Between the two sections, the expandable sleeve 7 and the tubular part 6 form the space 13 into which fluid is injected through the opening to expand the sleeve for the isolation of a first zone 40 from a second zone 41 in the borehole, which zones 40, 41 are shown in FIG. 1.

In another aspect, the expandable sleeve 7 may comprise at least two different materials, one having a higher strength and thereby lower ductility than the other material having a lower strength but higher ductility. Hereby, the expandable sleeve 7 may comprise the material having the higher strength in areas of the sleeve which are subjected to high hydraulic collapse pressure, when the sleeve is expanded, and comprise the material having a lower strength in the remaining areas of the sleeve. When the expandable sleeve 7 comprises a material of higher strength with low ductility in certain areas, having a material of lower strength but high ductility in the remaining areas, the expandable sleeve maintains sufficient ductility whilst the lower strength expandable sleeve material gains in collapse resistance. Once expanded, the overall effect is an expandable sleeve 7 with a higher collapse resistance close to or at the areas where the sleeve comprises the material of higher strength.

In another aspect, both ends 9, 10 of the expandable sleeve 7 are fixed to the well tubular structure 3. Normally, when the expandable sleeve 7 expands diametrically outwards, the increase in diameter of the expandable sleeve will cause the length of the sleeve to shrink and the thickness of the wall of the sleeve to become somewhat decreased.

If two ends 9, 10 of the sleeve 7 are fixed and no other changes are made to the design of prior art annular barriers, the degree to which the wall thickness would have to be decreased to achieve high diametrical expansion would be increased, leading to a lower collapse rating and a possible burst of material.

In an additional aspect, the expandable sleeve 7 is provided with a series of circumferential corrugations along the length of the expandable sleeve. The series of circumferential corrugations enables an increase in the length of the expandable sleeve 7 between the two fixed ends 9, 10 without increasing the distance between the two fixed ends.

After forming the above-mentioned corrugations, the expandable sleeve 7 may be subjected to some kind of treatment, e.g. heat treatment, to return the material of the sleeve 7 to its original metallurgical condition.

In the transition area, either the sleeve 7 itself or the additional material 30 may be machined to obtain a somewhat smaller wall thickness on the inner face 8 of the sleeve in order to control where the bending of the sleeve is initiated during expansion of the sleeve.

During expansion of the expandable sleeve 7, the corrugations are straightened out, providing the additional material 30 necessary for large diametrical expansion (e.g. 40% in diameter) without overly decreasing the wall thickness and while still keeping the two ends 9, 10 fixed. This is shown in FIG. 10. Preventing excessive decrease in wall thickness will maintain the collapse rating of the expandable sleeve 7, which will be appreciated by the skilled person.

Fixing the two ends 9, 10 while at the same time achieving a maximum diametrical expansion capability (e.g. 40% in diameter) is particularly advantageous in that it eliminates moving parts and thus the expensive and risky high pressure seals required for these moving parts. This is of particular importance in regard to high temperatures or corrosive well environments, e.g. Acid, $H_2S$, etc.

In another aspect, the wall thickness of the expandable sleeve 7 along the length of the sleeve may be profiled, which will allow control of the expansion in relation to where wall thinning of the expandable sleeve would occur. The profiling may be made to the expandable sleeve 7 via lamination of the same or different materials to the surface of the expansion sleeve or could be effected via machining or rolling of the expandable sleeve to varying thicknesses.

When the expansion is controlled through varying the wall thickness, it is possible to vary the collapse rating at certain points along the length of the expandable sleeve 7.

In FIG. 1, one end of the annular barrier 1 is slidable, meaning that the connection part 12 in which the sleeve 7 is fastened is slidably connected with the tubular part 6. When the expandable sleeve 7 is expanded in a direction transverse to the longitudinal direction of the annular barrier 1, the sleeve will, as mentioned above, tend to shorten in its longitudinal direction, if possible. When one end is slidable, the length of the sleeve 7 may be reduced, making it possible to expand the sleeve even further since it is not stretched as much as when it is fixedly connected with the tubular part 6.

However, having one slidable end increases the risk of the seals 20 becoming leaky over time. A bellows may therefore be fastened to the slidable connection part 12 and fixedly fastened in a third connection part. In this way, the first and third connection parts can be fixedly connected to the tubular part 6. The expandable sleeve 7 is firmly fixed to the first connection part 12 and to the slidable connection part 12, and the bellows is firmly fixed to the slidable connection part 12 and the third connection part. Accordingly, the connection parts 12, the expandable sleeve 7 and the bellows together form a tight connection preventing well fluid from entering the tubular structure 3.

The incorporation of two ends 9, 10 fixed with maximum diametrical expansion capability is considered beneficial in that this would eliminate moving parts, and no expensive and risky high pressure seals within these moving parts are needed. This is of particular importance when considering high temperature or corrosive well environments, e.g. Acid, $H_2S$ etc.

When the annular barrier 1 has a slidable connection part 12 between the sleeve 7 and the tubular part 6, the expansion capability of the sleeve is increased by up to 100% compared to an annular barrier without such a slidable connection part 12.

In another embodiment, the sleeve 7 has an outer face having two sealing elements opposite an increased thickness of the sleeve. When expanded, the sealing elements fit into a groove created by the increased thickness and seal against the inner wall of the borehole 5.

The sealing elements have an outer corrugated face for increasing the sealing ability. The sealing elements have a triangular cross-sectional shape so as to fit the groove occurring in the sleeve 7 during expansion. The sealing elements are made of an elastomer or similar material having a sealing ability and being flexible.

By collapse pressure is meant the pressure by which an outside pressure can collapse an expanded sleeve 7. The higher the collapse pressure, the higher the pressure from the formation and the annulus the expanded sleeve 7 is capable of withstanding before collapsing.

Figure 5:
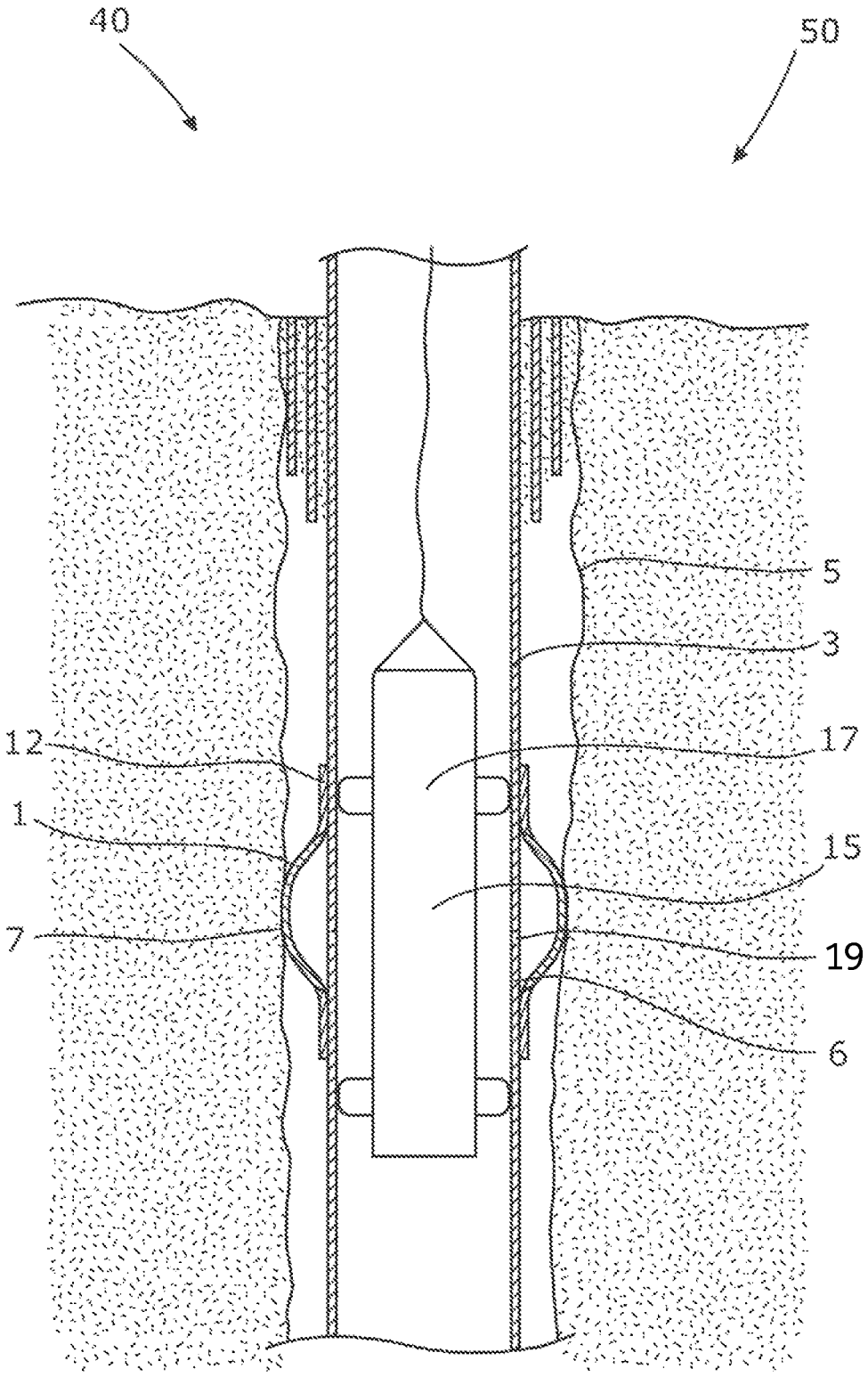
FIG. 5 shows a system according to the invention.

The invention also relates to a downhole system 50 having a well tubular structure 3 and an annular barrier 1 or a plurality of annular barriers, as shown in FIG. 5. In another embodiment, the system has a double annular barrier. The double annular barrier 1 has two end connection parts 12 and a middle connection part. The two expandable sleeves 7 are fastened to one end connection part and the middle part. The middle connection part is slidable as is one of the end connection parts 12. The other end connection part 12 is firmly fastened to the tubular part 6. The annular barrier 1 has two openings for injection of pressured fluid for expansion of the sleeves 7.

In another embodiment of a double annular barrier 1, the barrier only has one opening for injection of pressured fluid for expansion of the sleeves 7. The annular barrier 1 has two cavities, and the middle connection part 12 has a channel fluidly connecting the two cavities so that fluid for expanding the cavity having the opening can flow through the channel to expand the other sleeve 7 as well.

The present invention also relates to an annular barrier system 40, as shown in FIG. 5, comprising an annular barrier 1 as described above. The annular barrier system 40 moreover comprises an expansion tool 15 for expanding the expandable sleeve 7 of the annular barrier 1. The tool 15 expands the expandable sleeve 7 by applying pressurised fluid through a passage 19 in the tubular part 6 into the space 13 between the expandable sleeve 7 and the tubular part 6.

The expansion tool 15 may comprise an isolation device 17 for isolating a first section outside the passage or valve 19 between an outside wall of the tool and the inside wall of the well tubular structure 3. The pressurised fluid is obtained by increasing the pressure of the fluid in the isolation device 17. When a section of the well tubular structure 3 outside the passage 19 of the tubular part 6 is isolated, it is not necessary to pressurise the fluid in the entire well tubular structure 3, just as no additional plug is needed, as is the case in prior art solutions. When the fluid has been injected into the cavity 13, the passage or valve 19 is closed.

In the event that the tool 15 cannot move forward in the well tubular structure 3, the tool may comprise a downhole tractor, such as a Well Tractor®.

The tool 15 may also use coiled tubing for expanding the expandable sleeve 7 of an annular barrier 1 or of two annular barriers at the same time. A tool 15 with coiled tubing can pressurise the fluid in the well tubular structure 3 without having to isolate a section of the well tubular structure; however, the tool may need to plug the well tubular structure 3 further down the borehole 5 from the two annular barriers 1 to be operated. The annular barrier system 40 of the present invention may also employ a drill pipe or a wireline tool for expanding the sleeve 7.

In one embodiment, the tool 15 comprises a reservoir containing the pressurised fluid, e.g. when the fluid used for expanding the sleeve 7 is cement, gas or a two-component compound.

An annular barrier 1 may also be called a packer or similar expandable means. The well tubular structure 3 can be the production tubing or casing or a similar kind of tubing downhole in a well or a borehole. The annular barrier 1 can be used both between the inner production tubing and an outer tubing in the borehole or between a tubing and the inner wall of the borehole 5. A well may have several kinds of tubing, and the annular barrier 1 of the present invention can be mounted for use in all of them.

The valve 19 may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve 7 may be a cold-drawn or hot-drawn tubular structure.

The fluid used for expanding the expandable sleeve 7 may be any kind of well fluid present in the borehole 5 surrounding the tool 15 and/or the well tubular structure 3. Also, the fluid may be cement, gas, water, polymers, or a two-component compound, such as powder or particles mixing or reacting with a binding or hardening agent. Part of the fluid, such as the hardening agent, may be present in the cavity 13 before injecting a subsequent fluid into the cavity.

Although the invention has been described in the above in connection with preferred embodiments of the invention, it will be evident for a person skilled in the art that several modifications are conceivable without departing from the invention as defined by the following claims.

The invention claimed is:

1. An annular barrier configured to be expanded in an annulus between a well tubular structure and an inside wall of a borehole downhole, comprising:

a tubular part for mounting as part of the well tubular structure, an expandable sleeve composed of a first metal, the expandable sleeve surrounding the tubular part and defining and having a surface in contact with a cavity, the cavity being configured to be in fluid communication with an inside of the tubular part, the expandable sleeve having a longitudinal extension, an inner face opposing the tubular part and two ends, a connection part composed of a second metal, the connection part being arranged at least partially in contact with the tubular part and configured to connect the expandable sleeve with the tubular part, an opening configured to let fluid into the cavity to expand the sleeve, and a transition area comprising a connection of the sleeve with the connection part, wherein:

the first metal is a more flexible type of metal than the second metal; and the annular barrier comprises a restriction element in the transition area, the restriction element being configured to restrict expansion of the sleeve in the transition area.

2. The annular barrier according to claim 1, wherein the transition area extends along the longitudinal extension of the expandable sleeve from a first point at the connection to a predetermined second point on the expandable sleeve.

3. The annular barrier according to claim 2, wherein the expandable sleeve is more restricted in expanding at the first point than at the second point.

4. The annular barrier according to claim 3, wherein the restriction element is a projecting part of the connection part.

5. The annular barrier according to claim 4, wherein the projecting part tapers towards the expandable sleeve.

6. The annular barrier according to claim 5, wherein each end of the expandable sleeve has a tapering shape corresponding to a shape of the projecting part.

7. The annular barrier according to claim 6, wherein the thickness of the expandable sleeve decreases from a thickness of the connection part to a thickness less than 95% of the thickness of the connection part.

8. The annular barrier according to claim 6, wherein the thickness of the expandable sleeve decreases from a thickness of the connection part to a thickness less than 90% of the thickness of the connection part.

9. The annular barrier according to claim 6, wherein the thickness of the expandable sleeve decreases from a thickness of the connection part to a thickness less than 80% of the thickness of the connection part.

10. The annular barrier according to claim 1, wherein the restriction element is an additional ring surrounding the expandable sleeve, the additional ring being connected with the connection part and tapering from the connection part towards the expandable sleeve.

11. The annular barrier according to claim 1, wherein the restriction element is an increased thickness of the expandable sleeve, provided by adding an additional material at least on an outside of the expandable sleeve, which material tapers from the connection part towards the sleeve.

12. The annular barrier according to claim 1, wherein the first metal has an elongation of 35-70%.

13. The annular barrier according to claim 1, wherein the second metal has an elongation of 10-35%.

14. The annular barrier according to claim 1, wherein the tubular part has a first section and a second section arranged at opposing sides of an intermediate part and at a distance from the opening in the tubular structure, the tubular part having, in the first section and second section, an increased outer diameter and an increased wall thickness in relation to an outer diameter and a wall thickness of the intermediate part of the tubular part.

15. The annular barrier according to claim 14, wherein a first connection part is arranged in a sliding manner in relation to the first section of the tubular part to form a slidable connection part and a second connection part is fastened to the tubular part in a sealing connection in relation to the second section of the tubular part.

16. The annular barrier according to claim 15, wherein the sealing connection seals the cavity with a seal arranged in the slidable connection part.

17. The annular barrier according to claim 14, wherein each connection part has a projecting part overlapping the expandable sleeve.

18. The annular barrier according to claim 17, wherein the projecting part of the connection part is welded together with the expandable sleeve.

19. An annular barrier system comprising an expansion tool and an annular barrier according to claim 1.

20. The annular barrier system according to claim 19, wherein the expansion tool comprises explosives, pressurised fluid, cement, or a combination thereof.

21. A downhole system comprising a well tubular structure and at least one annular barrier according to claim 1.

22. The annual barrier according to claim 1, wherein the first metal has a elongation of at least 40%.

23. The annular barrier according to claim 1, wherein the first metal has an elongation of 40-50%.

24. The annular barrier according to claim 1, wherein the second metal has an elongation of 25-35%.

* * * * *